US007252134B2

(12) United States Patent
Crafton et al.

(10) Patent No.: US 7,252,134 B2
(45) Date of Patent: Aug. 7, 2007

(54) METHOD AND APPARATUS FOR REMOVAL OF FLASHING AND BLOCKAGES FROM A CASTING

(75) Inventors: Scott P. Crafton, Marietta, GA (US); Paul M. Crafton, Kennesaw, GA (US); Ian French, Kennesaw, GA (US); Jim Garrett, Acworth, GA (US)

(73) Assignee: Consolidated Engineering Company, Inc., Kennesaw, GA (US)

( * ) Notice: Subject to any disclaimer, the term of this patent is extended or adjusted under 35 U.S.C. 154(b) by 0 days.

(21) Appl. No.: 11/167,482

(22) Filed: Jun. 27, 2005

(65) Prior Publication Data

US 2006/0000571 A1 Jan. 5, 2006

Related U.S. Application Data

(60) Provisional application No. 60/602,131, filed on Aug. 17, 2004, provisional application No. 60/583,438, filed on Jun. 28, 2004.

(51) Int. Cl.
*B22D 29/00* (2006.01)
*B22D 27/04* (2006.01)

(52) U.S. Cl. ..... 164/76.1; 164/131; 164/132; 164/5

(58) Field of Classification Search ..... 164/76.1, 164/131, 132, 151.4, 154.6, 270.1, 5, 404
See application file for complete search history.

(56) References Cited

U.S. PATENT DOCUMENTS

| | | | | |
|---|---|---|---|---|
| 4,336,076 | A * | 6/1982 | Edamura et al. | 148/549 |
| 4,411,709 | A | 10/1983 | Nakanishi | |
| 5,121,786 | A * | 6/1992 | Kawase et al. | 164/98 |
| 5,294,094 | A | 3/1994 | Crafton et al. | |
| 5,565,046 | A | 10/1996 | Crafton et al. | |
| 5,738,162 | A | 4/1998 | Crafton | |
| 6,217,317 | B1 | 4/2001 | Crafton et al. | |
| 6,588,487 | B2 | 7/2003 | Crafton et al. | |
| 6,622,775 | B2 | 9/2003 | Crafton et al. | |
| 6,672,367 | B2 * | 1/2004 | Crafton et al. | 164/5 |
| 6,739,380 | B2 * | 5/2004 | Schlienger et al. | 164/131 |
| 2002/0104596 | A1 | 8/2002 | Crafton et al. | |
| 2004/0123786 | A1 | 7/2004 | Crafton et al. | |
| 2005/0072549 | A1 | 4/2005 | Crafton et al. | |
| 2005/0257858 | A1 | 11/2005 | Crafton et al. | |

FOREIGN PATENT DOCUMENTS

| | | | | |
|---|---|---|---|---|
| JP | 63016853 | * | 1/1988 | 164/132 |
| WO | WO 2001/08836 A1 | | 2/2001 | |
| WO | WO 2004/014581 A2 | | 2/2004 | |

* cited by examiner

*Primary Examiner*—Kevin Kerns
*Assistant Examiner*—I.-H. Lin
(74) *Attorney, Agent, or Firm*—Womble Carlyle Sandridge & Rice, PLLC

(57) ABSTRACT

Various systems and apparatuses for processing a metal casting are provided.

8 Claims, 3 Drawing Sheets

METHOD AND APPARATUS FOR REMOVAL OF FLASHING AND BLOCKAGES FROM A CASTING

CROSS-REFERENCE TO RELATED APPLICATIONS

This application claims the benefit of U.S. Provisional Application No. 60/583,438, filed Jun. 28, 2004, and U.S. Provisional Application No. 60/602,131, filed Aug. 17, 2004, both of which are incorporated by reference herein in their entirety.

BACKGROUND

A traditional casting process for forming metal castings employs one of various types of molds for example, a green sand mold, a precision sand mold, or a steel die, having the exterior features of a desired casting, such as a cylinder head or engine block, formed on its interior surfaces. A core formed from sand and a suitable binder material and defining the interior features of the casting is placed within the mold or die. The sand core used to produce contours and interior features within the metal castings typically must be removed and reclaimed.

The mold or die is then filled with a molten metal or metal alloy. The casting is then removed from the mold or die and moved to a treatment furnace for heat-treating, removal of the sand cores, reclamation of the sand from the sand cores, and, at times, aging. Heat treating and aging are processes that condition the metal or metal alloy to achieve various desired resulting properties for a given application.

Once the casting is formed, several distinctly different steps generally must be carried out in order to heat treat the metal casting and reclaim the sand from the sand core. First, a portion of the sand core is separated from the casting using one or more techniques. For example, sand may be chiseled away from the casting or the casting may be physically shaken or vibrated to break-up the sand core and remove the sand. Additionally, where the molds include one or more orifices for accessing the cores, the orifices that are blocked must be cleared.

After or during the sand is removed from the casting, heat treating and aging of the casting generally are carried out in subsequent steps. The casting is typically heat treated if it is desirable to, among other treatments, strengthen or harden the casting or to relieve internal stresses in the casting.

Although many advances have been made in the metal casting industry, there remains a need for an improved process for removing the cores and residual sand from the casting.

Various objects, features, and advantages of the present invention will become apparent to those skilled in the art upon a review of the following detailed description when taken in conjunction with the accompanying drawings.

DETAILED DESCRIPTION

Various aspects of the present invention generally relate to casting processes. In one aspect, the present invention relates to various methods and apparatuses for improving the removal of flashing and other blockages to gain access to a core within a casting.

Metal casting processes generally are known to those skilled in the art and will be described only briefly for reference purposes. It will be understood that the present invention can be used in any type of casting process, including metal casting processes for forming aluminum, iron, steel, and/or other types of metal and metal alloy castings. The present invention thus is not limited to use with a particular casting process or a particular type or types of metals or metal alloys.

Figure 1:
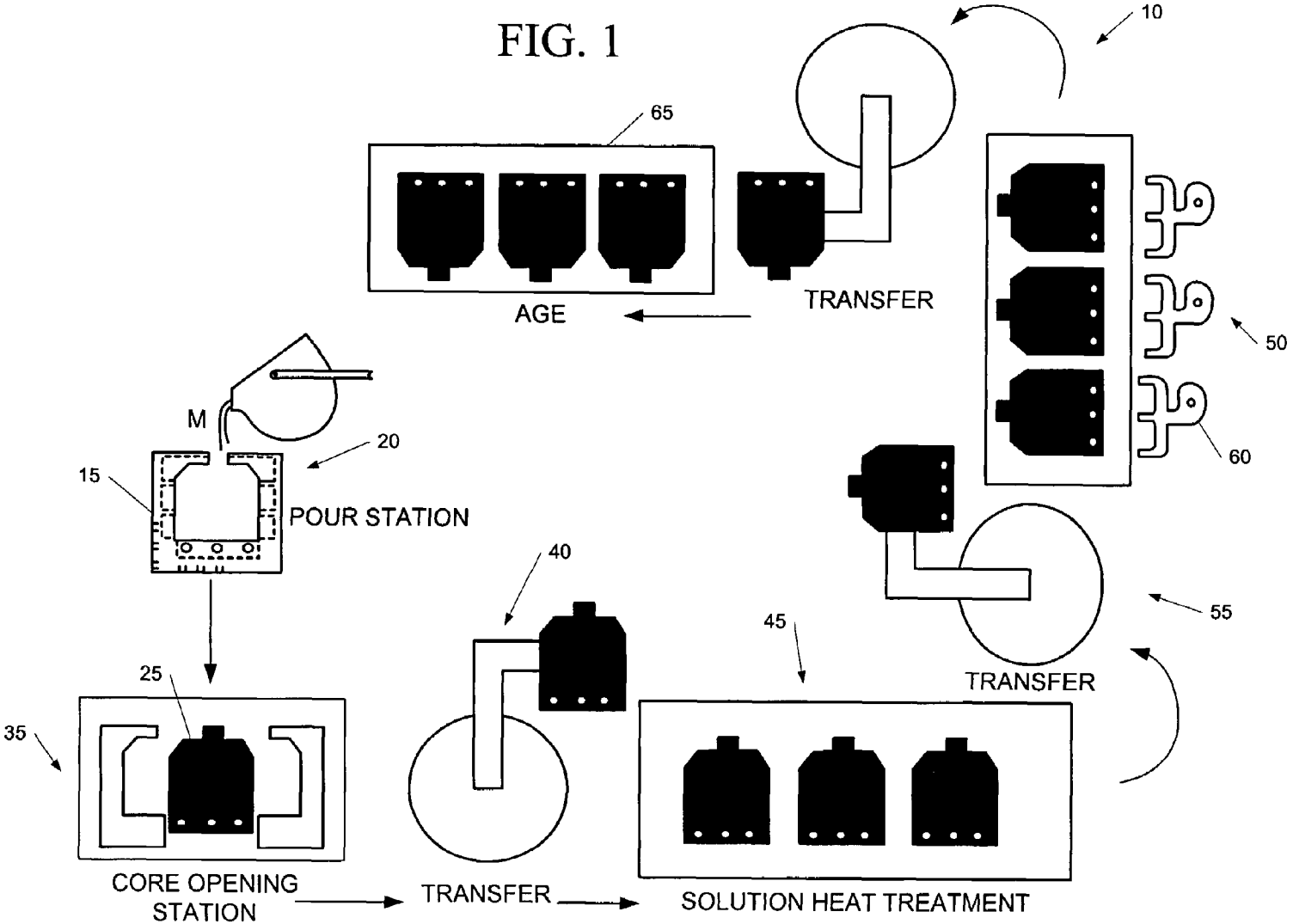
FIG. 1 depicts an exemplary metal casting process according to various aspects of the present invention.

FIG. 1 generally illustrates an exemplary metallurgical casting process 10 according to various aspects of the present invention. A molten metal or metallic alloy M typically is poured into a die or mold 15 at a pouring or casting station 20 for forming a casting 25, such as a cylinder head, engine block, or similar cast part. The mold generally includes a plurality of walls that define an internal cavity within which the molten metal is received. The cavity is formed with a relief pattern that forms the internal features of the castings. A pour opening generally is formed in the outer wall, typically in the top of the mold, and communicates with the internal cavity to allow the molten metal to be poured or otherwise introduced into the mold. A core formed from sand and an organic binder, such as a phenolic resin or any other suitable binder material, is received or placed within a mold to create hollow cavities, casting details, and/or core prints within the casting. The casting may include one or more core apertures that provide access to the core.

Any suitable mold or die may be used with various aspects of the present invention. For example, the mold may be a permanent mold or die (including low and high pressure die casting), typically formed from a metal such as steel, cast iron, or other suitable material. Such a mold may have a clam-shell style design for ease of opening and removal of the casting therefrom. Alternatively, the mold may be a "precision sand mold" or "green sand mold," which generally is formed from a sand material such as silica sand, zircon sand, or other suitable material mixed with a binder such as a phenolic resin or other suitable binder. Similarly, the core may be formed form a sand material and a binder, for example, a phenolic resin, phenolic urethane "cold box" binder, or any other suitable binder material. Alternatively, the mold may be a semi-permanent sand mold, which typically has an outer mold wall formed from sand and a binder material, a metal such as steel, or a combination of both types of materials.

It will be understood that the term "mold" will be used hereafter to refer generally to all types of molds as discussed above, including permanent or metal dies, semi-permanent and precision sand mold type molds, and other metal casting molds, except where a particular type mold is specified.

A heating source or element (not shown), such as a heated air blower or other suitable gas-fired or electric heater mechanism, or fluidized bed, may be provided adjacent the pouring station for preheating the mold. A pre-heating process may be used to maintain the temperature of the molten metal and/or the casting at an elevated temperature, for example, at least about the heat treatment temperature, to minimize heat loss and to improve process efficiency. Additionally, in some instances, pre-heating the mold may initiate the heat treatment process of the casting within the mold.

The mold may be preheated to any suitable temperature as needed or desired for the particular metal or alloy used to form the casting. For example, for aluminum, the mold may be preheated to a temperature of from about 400° C. to about 600° C. Other preheating temperatures for various metallic alloys and other metals are well known to those skilled in the art and include a wide range of temperatures from about 300° C. to about 1200° C. Other preheating temperatures are contemplated hereby.

Depending on the aggregate and binder used to make the mold and/or core, a lower preheating temperature may be used to prevent mold and core deterioration during pouring and solidification. In such cases, and where the metal process temperature should be higher, a suitable temperature control method, such as induction heating or other processes known the art, may be employed to achieve the desired process results.

Alternatively, the mold may be provided with an internal heating source or element. For example, a permanent type metal die may include one or more cavities or passages adjacent the casting through which a controlled heated fluid medium, such as water or a thermal oil, may be received and/or circulated. Thereafter, a fluid media having a lower temperature, for example, from about 250° C. to about 300° C., may be introduced or circulated through the mold to cool the castings and cause the castings to at least partially solidify. A higher temperature thermal oil, for example, heated to a temperature of from about 500° C. to about 550° C., then may be introduced and/or circulated through the die to arrest the cooling of the casting and, in some instances, to raise the temperature of the castings back to a soak temperature for heat treating the castings.

After the molten metal or metallic alloy has been poured into the mold and has at least partially solidified into a casting, the mold with the casting therein is removed from the pouring station by a transfer mechanism and transferred to a loading station (not shown). The transfer mechanism may include a transfer robot (not shown), winch, or other type of conventionally known transfer mechanism. At the loading station, the casting may be removed from the mold and loaded into a saddle or basket that includes locating devices to maintain the casting in an indexed position relative to the process equipment and other castings. In doing so, it can be assured that the casting is oriented as needed to accomplish core removal and/or cleaning, as will be described below.

Returning to FIG. 1, according to one aspect of the present invention, the casting then is transferred to a core opening station 35. At the core opening station 35, the core apertures or openings are cleared at least partially to dislodge, separate, and/or remove (collectively "clear" or "remove") blockages and to provide access to the core for subsequent processing. Additionally, all or a portion of the core may be removed during the core opening process.

Although the core apertures may be cleared at various points throughout the metal casting process, there are several advantages to clearing the core apertures prior to core removal and/or heat treatment. For example, by clearing blocked core apertures, the decoring process is enhanced, thereby substantially reducing the heat treatment time. Additionally, the quenching process (discussed below) may be improved, thereby resulting in improved metal quality and, in some instances, a decreased a quench time or overall process time. Accordingly, the reduction in time required for decoring and heat treatment may allow the process to be conducted without the need for the conventional queuing methods of casting loads into baskets, trays, or other multiple casting load carriers. Instead, a direct contact conveyance means, such as a chain, roller, walking beam, or other similar conveying mechanism may be used.

The core apertures may be cleared using any of numerous suitable techniques. In one aspect, the core apertures are cleared using a "punching" system that physically knocks out the blockage from the aperture. In another aspect, the core apertures are cleared using a "trimming" system that penetrates and "cuts" the blockages from the apertures. Such punching and trimming systems may employ a physical or mechanical cutter, such as a laser, milling machine, drill, boring device, saw, or punch press system with piercing/upsetting dies to cut or otherwise physically penetrate the blockage. The trimming device also may be used to remove the feed gates and/or risers created during formation of the casting.

In yet another aspect, the blockage may be removed by shaking or vibrating the casting. In still another aspect, the blockage may be removed by impinging the blockage with sound. In a still further aspect, the blockage may be removed by blasting or impinging it with a heated or unheated fluid or particulate media, for example, water, oil, air, or sand. Various nozzles, impingement pressures, volumes, and temperatures of the fluids may be used as needed to achieve the desired results and are contemplated hereby. Any size and arrangement of nozzles may be used as desired. In one aspect, each nozzle may have a diameter of from about 0.125 in. to about 1.00 in, for example, about 0.25 in. Likewise, the media may be supplied at any suitable flow rate and pressure, and in one aspect, may be supplied at a flow rate of from about 10 to about 1300 cfm at from about 5 to about 150 psi.

Any of such devices may be attached to a robotic mechanism adapted to traverse the casting to clear the core apertures. Where such a device is used, the casting may be held stationary using clamps or other securing devices.

In some instances, "pear pins," rods, or similar elements are used to push, urge, or otherwise assist or promote the removal of the casting from its mold. If desired, such elements may be positioned so that one or more selected elements will engage and pierce the blocked apertures as the casting is urged from its mold. Such elements may include devices for monitoring the temperature of the casting when the elements are engaged therein.

Optionally, the sand removed from the core opening process and any other process described herein or contemplated hereby then may be purified. The purification process may include burning the binder that coats the sand, abrading the sand, scrubbing the sand and passing portions of the sand through screens. Some of the sand may be subjected to multiple reclaiming processes until sufficiently pure sand is obtained.

Prior to, during, and after the core opening process, the temperature of the casting may be maintained at or above a process control temperature. It has been discovered that, as the metal of the casting is cooled down, it reaches a temperature or range of temperatures referred to herein as the "process control temperature" or "process critical temperature," below which the time required to both raise the castings to the heat treating temperature and perform the heat treatment is significantly increased. It will be understood by those skilled in the art that the process control temperature for the castings being processed by the present invention will vary depending upon the particular metal and/or metal alloys being used for the castings, the size and shape of the castings, and numerous other factors.

In one aspect, the process control temperature may be about 400° C. for some alloys or metals. In another aspect, the process control temperature may be from about 400° C. to about 600° C. In another aspect, the process control temperature may be from about 600° C. to about 800° C. In yet another aspect, the process control temperature may be from about 800° C. to about 1100° C. In still another aspect, the process control temperature may be from about 1000° C. to about 1300° C. for some alloys or metals, for example, iron. In one particular example, an aluminum/copper alloy may have a process control temperature of from about 400° C. to about 470° C. In this example, the process control temperature generally is below the solution heat treatment temperature for most copper alloys, which typically is from about 475° C. to about 495° C. While particular examples are provided herein, it will be understood that the process control temperature may be any temperature, depending upon the particular metal and/or metal alloys being used for the casting, the size and shape of the casting, and numerous other factors.

When the metal of the casting is within the desired process control temperature range, the casting typically will be cooled sufficiently to solidify as desired. However, if the metal of the casting is permitted to cool below its process control temperature, it has been found that the casting may need to be heated for at least about 4 additional minutes for each minute that the metal of the casting is cooled below the process control temperature to reach the desired heat treatment temperature, for example, from about 475° C. to about 495° C. for aluminum/copper alloys, or from about 510° C. to about 570° C. for aluminum/magnesium alloys. Thus, if the casting cools below its process control temperature for even a short time, the time required to heat treat the casting properly and completely may be increased significantly. In addition, it should be recognized that in a batch processing system, where several castings are processed through the heat treatment station in a single batch, the heat treatment time for the entire batch of castings generally is based on the heat treatment time required for the casting(s) with the lowest temperature in the batch. As a result, if one of the castings in the batch being processed has cooled to a temperature below its process control temperature, for example, for about 10 minutes, the entire batch typically will need to be heat treated, for example, for at least an additional 40 minutes to ensure that all of the castings are heat treated properly and completely.

The process control temperature may be maintained in a process control temperature station (not shown) that may be separate from or integral with other process components, such as the core opening station. The process control temperature station may include various combinations of heating and temperature control features. In one aspect, the process control temperature station includes a radiant chamber with a series of heat sources mounted therein, for example, along the walls and/or ceiling of the chamber. Typically, multiple heat sources may be used and may include one or more various different types of heat sources or heating elements, including radiant heating sources such as infrared, electromagnetic and inductive energy sources, conductive, convective, and direct impingement type heat sources, such as gas fired burner tubes introducing a gas flame into the chamber. In addition, the side walls and ceiling of the radiant chamber may be formed from or coated with a high temperature radiant material, such as a metal, metallic film or similar material, ceramic, or composite material capable of radiating heat. The radiant coating generally forms a non-stick surface on the walls and ceilings. As the walls and ceiling of the chamber are heated, the walls and ceiling tend to radiate heat toward the casting, and at the same time, the surfaces generally is heated to a temperature sufficient to burn off waste gases and residue such as soot, etc., from the combustion of the binders of the sand molds and/or cores to prevent collection and buildup thereof on the walls and ceiling of the chamber.

In one aspect, the process temperature control station may function as a holding area in front of the heat treatment station or chamber. The temperature of the casting may be maintained or arrested at or above the process control temperature, but equal to or below a desired heat treating temperature, to allow the casting to solidify fully while awaiting introduction into the heat treatment station. Thus, the system allows the pouring line or lines to be operated at a faster or more efficient rate without the casting having to sit in a queue or line waiting to be fed into the heat treatment station while exposed to the ambient environment, resulting in the casting cooling down below its process control temperature.

Various aspects of the present invention include systems for monitoring the temperature of the casting to ensure that the casting is maintained substantially at or above the process control temperature. For example, thermocouples or other similar temperature sensing devices or systems can be placed on or adjacent the casting or at spaced locations along the path of travel of the casting from the pouring station to a heat treatment furnace to provide substantially continuous monitoring. Alternatively, periodic monitoring at intervals determined to be sufficiently frequent may be used. Such devices may be in communication with a heat source, such that the temperature measuring or sensing device and the heat source may cooperate to maintain the temperature of the casting substantially at or above the process control temperature for the metal of the casting. It will be understood that the temperature of the casting may be measured at one particular location on or in the casting, may be an average temperature calculated by measuring the temperature at a plurality of locations on or in the casting, or may be measured in any other manner as needed or desired for a particular application. Thus, for example, the temperature of the casting may be measured in multiple locations on or in the casting, and an overall temperature value may be calculated or determined to be the lowest temperature detected, the highest temperature detected, the median temperature detected, the average temperature detected, or any combination or variation thereof.

Additionally, prior to entry into the heat treatment furnace, the casting may pass through an entry or rejection zone (not shown), where the temperature of each casting is monitored to determine whether the casting has cooled to an extent that would require and an excessive amount of energy to raise the temperature to the heat treatment temperature. The entry zone may be included in the process control temperature station or may be a separate zone. The temperature of the casting may be monitored by any suitable temperature sensing or measuring device, such as a thermocouple, to determine whether the temperature of the casting has reached or dropped below a pre-set or predefined rejection temperature. In one aspect, the predefined rejection temperature may be a temperature (for example, from about 10° C. to about 20° C.) below the process control temperature for the metal of the casting. In another aspect, the predefined rejection temperature may be a temperature (for example, from about 10° C. to about 20° C.) below the heat treatment temperature of the heat treatment furnace or oven. If the casting has cooled to a temperature equal to or below the predefined temperature, the control system may send a rejection signal to a transfer or removal mechanism. In response to the detection of a defect condition or signal, the subject casting may be identified for further evaluation or may be removed from the transfer line. The casting may be removed by any suitable mechanism or device including, but not limited to, a robotic arm or other automated device, or the casting may be removed manually by an operator.

As with the above, it will be understood that the temperature of the casting may be measured at one particular location on or in the casting, may be an average temperature calculated by measuring the temperature at a plurality of locations on or in the casting, or may be measured in any other manner as needed or desired for a particular application. Thus, for example, the temperature of the casting may be measured in multiple locations on or in the casting, and an overall value may be calculated or determined to be the lowest temperature detected, the highest temperature detected, the median temperature detected, the average temperature detected, or any combination or variation thereof.

Prior to or after completion of the core opening process, the casting may be transferred using any suitable device 40 individually or in batches to a heat treatment station 45 for heat treatment, sand core and/or sand mold breakdown and removal and, in some instances, for sand reclamation. Heat treatment may be used to strengthen or harden the casting, or to relieve internal stresses. The casting is heated to a suitable temperature, held at that temperature long enough to allow a certain constituent to enter into solid solution, and then cooled rapidly to hold that constituent in solution.

The heat treatment station generally includes a heat treatment furnace (not shown), typically a gas fired furnace or heated by a commonly allowable means, and generally includes a series of treatment zones or chambers for heat treating each casting and removal and reclamation of the sand material of the sand cores. Such heat treatment zones may include various types of heating environments such as conduction, including the use of fluidized beds, and convection or other commercially viable systems known in the art, such as using heated air flows. The number of treatment zones may vary as needed or required for a particular application to remove the sand cores. The residence time within the heat treatment station, or each zone thereof, may be relatively to the time needed for heat treating the casting to a desired level. It is also possible to age partially the casting within the heat treatment station if desired.

The heat treatment station may include various sources of heat in any suitable combination. Heat sources including convection heat sources such as blowers or nozzles that apply heated media such as air or other fluids, conduction heat sources such as a fluidized bed, inductive, radiant and/or other types of heat sources may be mounted within the walls and/or ceiling of the furnace chamber for providing heat and optional airflow about the casting in varying degrees and amounts to heat the casting to the proper heat treating temperatures. Such desired heat treating temperatures and heat treatment times will vary according to the type of metal or metal alloy from which the casting is being formed, as will be known to those skilled in the art.

Examples of various heat treatment furnaces that may be suitable for use with the present invention include those described in U.S. Pat. Nos. 5,294,094; 5,565,046; and 5,738,162, the disclosures of which are hereby incorporated by reference. A further example of a heat treatment furnace or station for use with the present invention is illustrated and disclosed in U.S. Pat. No. 6,217,317 and U.S. patent application Ser. Nos. 09/665,354, filed Sep. 9, 2000, and 10/051,666, filed Jan. 18, 2002, the disclosures of which are likewise incorporated herein by reference in their entirety. Such heat treatment stations or furnaces may include features for reclaiming the sand from the cores and/or molds dislodged during heat treatment of the casting.

According to another aspect of the present invention illustrated in FIG. 1, after the heat treatment is complete, the casting is transferred from the heat treatment station 45 to a cleaning station 50 via a robot or other automated means 55. The casting is placed into a vestibule having nozzles 60 positioned around the periphery of the casting. One or more nozzles may be positioned in direct alignment with the open orifices. Additionally, one or more nozzles may be inserted into the open orifices. The nozzles then direct an air, water, oil or other media jet at the orifices to assist with removal of the cores. During the cleaning process, some areas of the casting may be slightly quenched; however, any temperature change is likely minimal. After the cleaning process is complete, the casting may then be transferred to an aging oven 65.

Figure 2:
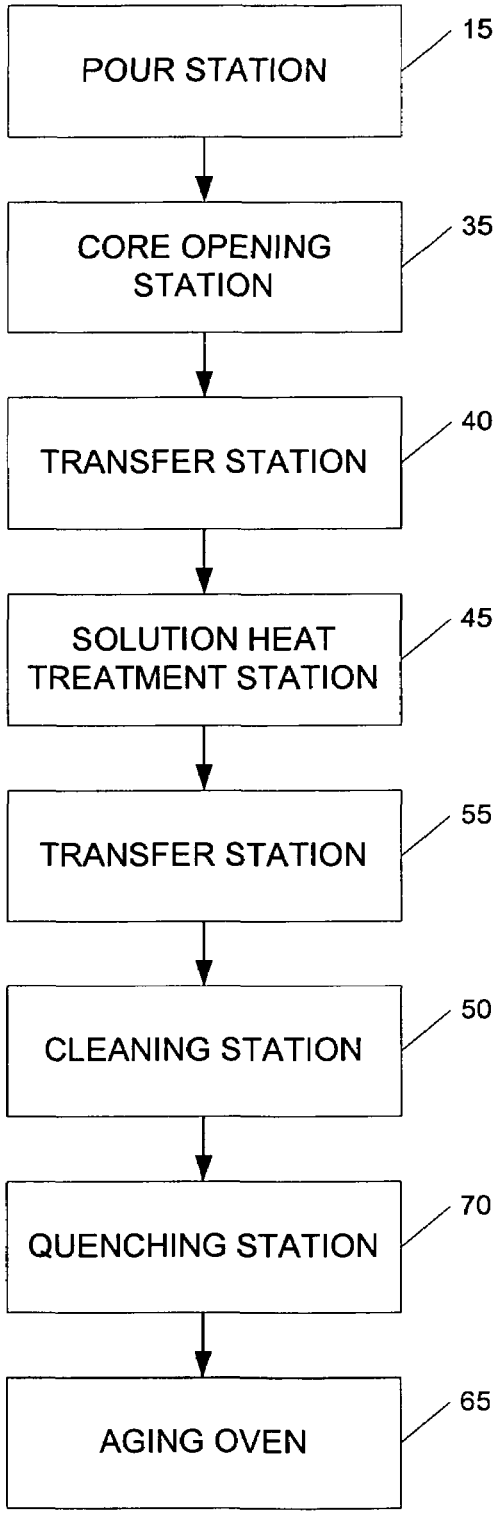
FIG. 2 depicts another exemplary metal casting process according to various aspects of the present invention.

According to another aspect of the present invention depicted in FIG. 2, the casting may be transferred to a quenching station 70 after cleaning 50. The quenching process provides a high volume/pressure of fluid media (water, air, steam, oil, etc.) to the casting via the cleared apertures or otherwise. The quenching process may utilize a quench tank or reservoir filled with a cooling fluid, such as water or other known media material, in which each casting or batch of castings are immersed for cooling and quenching. The quench tank or reservoir is designed to accommodate the size and type of casting being formed, the specific heat of the metal or metal alloy, and the temperatures to which each casting has been heated. The quench time and temperature may be controlled to achieve the desired resulting mechanical and physical properties of the casting. In some instances, the quench station may be maintained at about 120° F. to about 200° F. As above, the casting may then be transferred to an aging oven 65 immediately or at a later time dependent by the required process for the specific component.

Figure 3:
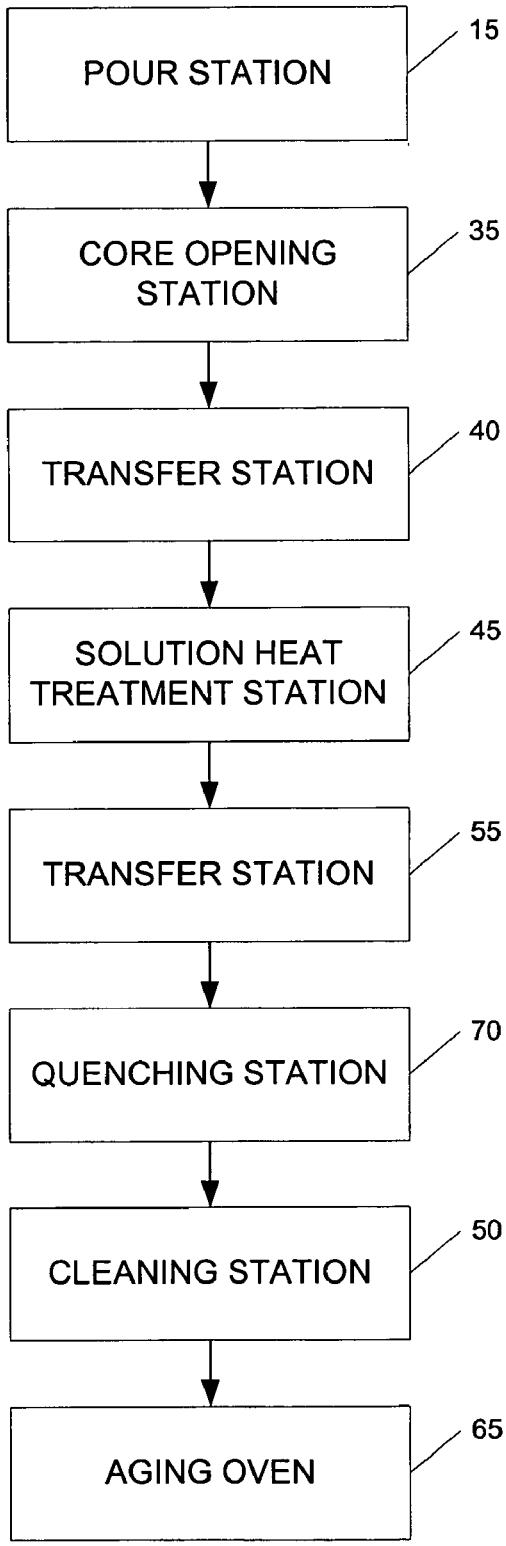
FIG. 3 depicts yet another exemplary metal casting process according to various aspects of the present invention.

According to another aspect of the present invention depicted in FIG. 3, after the solution heat treatment is complete, each casting is transferred from the heat treatment station 45 to a quenching station 70 for cleaning and further processing. The quenching station typically includes a quench tank having a cooling fluid such as water or other known coolant, or can comprise a chamber having a series of nozzles that apply cooling fluids such as air, water, or similar cooling media. As described above, the quenching process removes a substantial portion of the internal cores by providing a high volume of air, water, steam, and/or oil to the casting to reduce the temperature of the casting to a desired final temperature.

Often, the quenching media accumulates traces of sand from the castings. The sand then re-deposits on the casting. Thus, the casting thereafter may be transferred to a cleaning station 50 for further cleaning and processing. As described above, the cleaning process subjects the casting to a variable volume, pressure, and temperature of a media stream of air, water, oil, or steam. Where air is used to clean the casting, the cleaning process may further quench the casting. After cleaning the casting, the casting may then be placed into an aging oven 60 if desired.

Accordingly, it will be readily understood by those persons skilled in the art that, in view of the above detailed description of the invention, the present invention is susceptible of broad utility and application. Many adaptations of the present invention other than those herein described, as well as many variations, modifications, and equivalent arrangements will be apparent from or reasonably suggested by the present invention and the above detailed description thereof, without departing from the substance or scope of the present invention.

While the present invention is described herein in detail in relation to specific aspects, it is to be understood that this detailed description is only illustrative and exemplary of the present invention and is made merely for purposes of providing a full and enabling disclosure of the present invention. The detailed description set forth herein is not intended nor is to be construed to limit the present invention or otherwise to exclude any such other embodiments, adaptations, variations, modifications, and equivalent arrangements of the present invention, the present invention being limited solely by the claims appended hereto and the equivalents thereof.

What is claimed is:

1. A method of producing a metal casting comprising:

pouring a molten metal material into a mold to form a casting having a core aperture;

applying energy to the casting to arrest cooling of the casting and at least partially heat treat the casting;

removing the casting from the mold;

clearing the core aperture of the casting; and heat treating the casting.

2. The method of claim 1, further comprising maintaining the temperature of the casting at or above a process control temperature for the metal.

3. The method of claim 1, further comprising maintaining the temperature of the casting at or above a process control temperature for the metal until the casting is heat treated.

4. The method of claim 1, further comprising pre-heating the mold to a temperature of at least about the heat treatment temperature for the metal.

5. The method of claim 4, further comprising pouring the molten metal into the mold while the mold is at the pre-heated temperature.

6. The method of claim 1, wherein clearing the core aperture comprises punching, milling, drilling, lasering, or cutting a blockage within the core aperture, or blasting a fluid media at the blockage within the core aperture.

7. The method of claim 1, wherein clearing the core aperture comprises penetrating a blockage in the core aperture with an urging element as the casting is removed from the mold.

8. The method of claim 1, further comprising monitoring the temperature of the casting using a temperature measuring device in communication with the urging element.

* * * * *